United States Patent [19]

Brocia

[11] Patent Number: 4,973,949

[45] Date of Patent: Nov. 27, 1990

[54] DUAL WHEATSTONE BRIDGE STRAIN GAGE MARINE INTRUSION SENSOR

[76] Inventor: Robert Brocia, 15 Moore Rd., Bronxville, N.Y. 10708

[21] Appl. No.: 418,553

[22] Filed: Oct. 10, 1989

[51] Int. Cl.[5] ..... G08B 13/10

[52] U.S. Cl. ..... 340/666; 73/862.67; 340/984

[58] Field of Search ..... 340/666, 541, 984, 565; 73/862.67, 767; 324/706

[56] References Cited

U.S. PATENT DOCUMENTS

| | | | |
|---|---|---|---|
| 4,003,487 | 1/1977 | Downing | 340/666 |
| 4,138,882 | 2/1979 | Lockery et al. | 73/767 |
| 4,287,511 | 9/1981 | Scott et al. | 340/541 |

*Primary Examiner*—Glen R. Swann, III

*Attorney, Agent, or Firm*—Lackenbach Siegel Marzullo & Aronson

[57] ABSTRACT

Two wheatstone bridge circuits, each having detectors in the form of strain gages in the arms thereof, are connected to carry out detection of entry into the perimeter of the detection area such as the main deck of a boat. Each of the wheatstone bridge circuits has a strain gage mounted on the underside of the main deck or therein in a corresponding one of four areas of the perimeter being secured so that two strain gages of the system carry out intruder detection by imbalance of the corresponding bridges when an intruder enters an area. Each bridge circuit has an amplifier connected to receive the corresponding bridge circuit output and an AND logic circuit voltage output controls activating triggering of a monitor circuit when both bridge circuits are imbalanced. Each amplifier is adjustable so that individual bridge circuit sensitivity is possible to compensate for environmental and operating conditions on the main deck of a vessel or boat. The individual amplifiers can be tare adjusted to effect the equivalent or zeroizing the corresponding bridge if unbalanced without affecting the sensitivity of the corresponding bridge.

7 Claims, 3 Drawing Sheets

FIG. 1
PRIOR ART
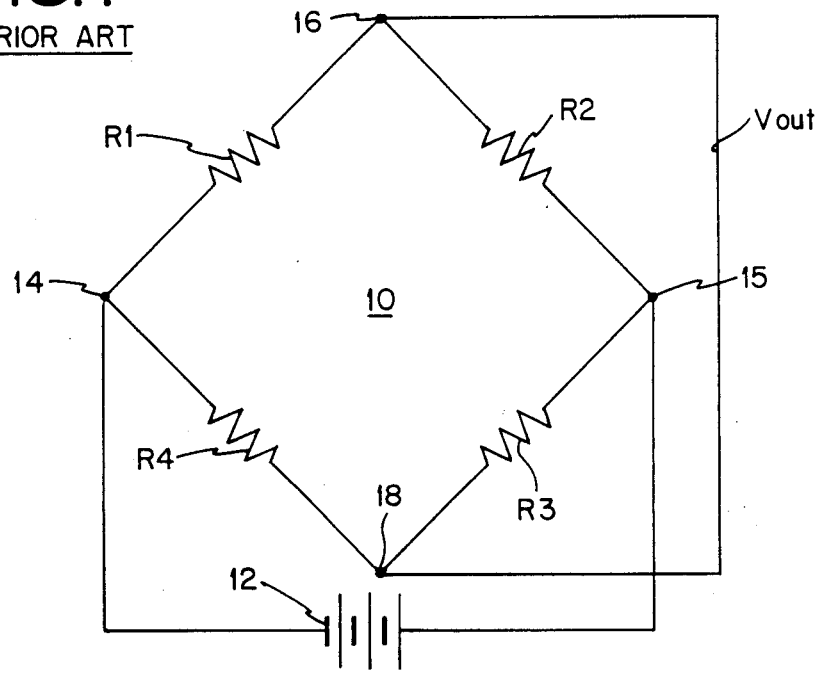
FIG. 2
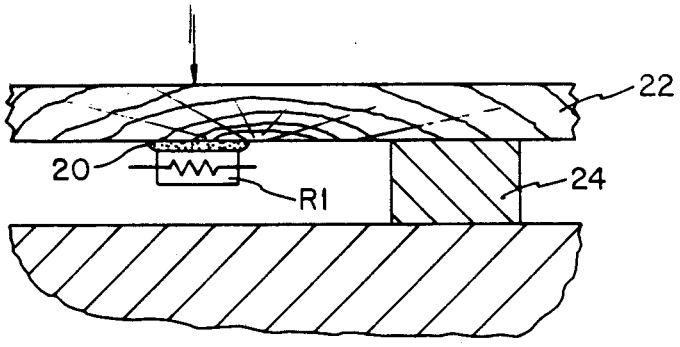
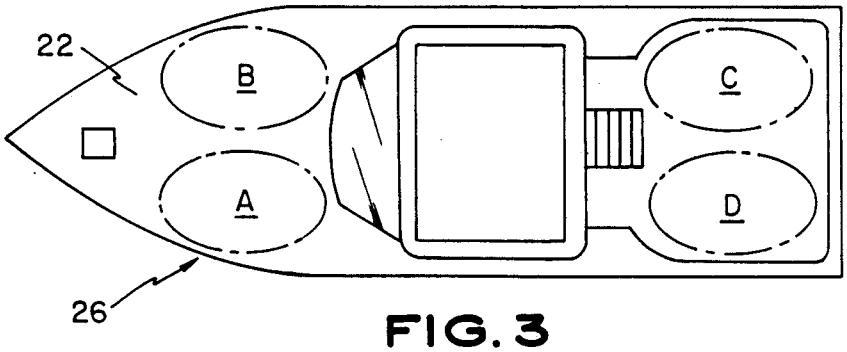
FIG. 3

DUAL WHEATSTONE BRIDGE STRAIN GAGE MARINE INTRUSION SENSOR

This invention relates generally to a perimeter intruder detection system for an area to be secured by detection of intrusion thereinto. More particularly it relates to a system for detecting the presence of an intruder on marine vessels, boats and the like.

The use of strain gages for detection of pressure and the use of air-filled mats and the like detectors is known. Moreover, the use of perimeter intruder detection systems by use of photoelectric systems is likewise well known. The use of a photoelectric system for detection of an intrusion onto a boat, for example, will require relatively complex equipment and the use of several photoelectric devices in order to insure coverage of the perimeter of the boat.

Moreover, in a marine environment a conventional detector installed outside the cabin area to detect an intrusion prior to entry of a boat cabin is subjected to a marine environment in which corrosive conditions take place and the accummulation of snow and rain generally precludes the use of air-filled mats or other similar detector devices.

SUMMARY OF THE INVENTION

It is a principal object of the present invention to provide perimeter protection by a detection system in which an alarm or monitor is activated when the deck of a vessel or boat is stepped on and without responding to disturbances due to environmental and other conditions not indicative of an intrusion.

The perimeter intruder detection system for an area constituting, for example, the top deck of a boat is formed by at least two wheatstone bridge circuits each arranged with arms thereof in corresponding four areas, for example, within a larger area constituting the perimeter of the boat. Each wheatstone bridge circuit has an arm in corresponding areas where the other wheatstone bridge circuit has an arm therein. Each arm of both of the wheatstone bridge circuits has a strain gage as a detection transducer for detection of entry and presence of an intruder. The wheatstone bridge circuits are provided with a conventional voltage input and develop a voltage output that activates an alarm, which can be audible or visual, or a monitor that will record and/or advise of an intrusion.

In order to maintain a sensitivity within the system which will detect only the desired intrusions each of the wheatstone bridge circuits are provided with an amplifier receiving the voltage output of the corresponding bridge. The individual amplifiers have a variable voltage output adjust thereof to adjust the sensitivity of the corresponding wheatstone bridge circuit to strain due to weight pressure applied to the strain-producing surfaces on which the strain gages are mounted or otherwise secured so as to be strain-responsive.

An AND gate is connected to receive the voltage output of the two amplifiers and the voltage output of the gate is connected to an alarm or monitor system which is activated in response to the output voltage of the AND gate.

DESCRIPTION OF THE DRAWINGS:

The invention will be better understood from the following description and claims in conjunction with the appended drawings in which:

FIG. 1, is a diagram illustrating a conventional wheatstone bridge circuit used in the invention;

FIG. 2 is a fragmentary diagramatic crosssection view of a boat deck illustrating the mounting of strain gages in a wheatstone bridge circuit according to the invention;

FIG. 3 is a diagrammatic plan view of a top side deck of a boat and is illustrative of the location of detection areas in which detectors in the form of strain gages are mounted in the system according to the invention;

Figure 4:
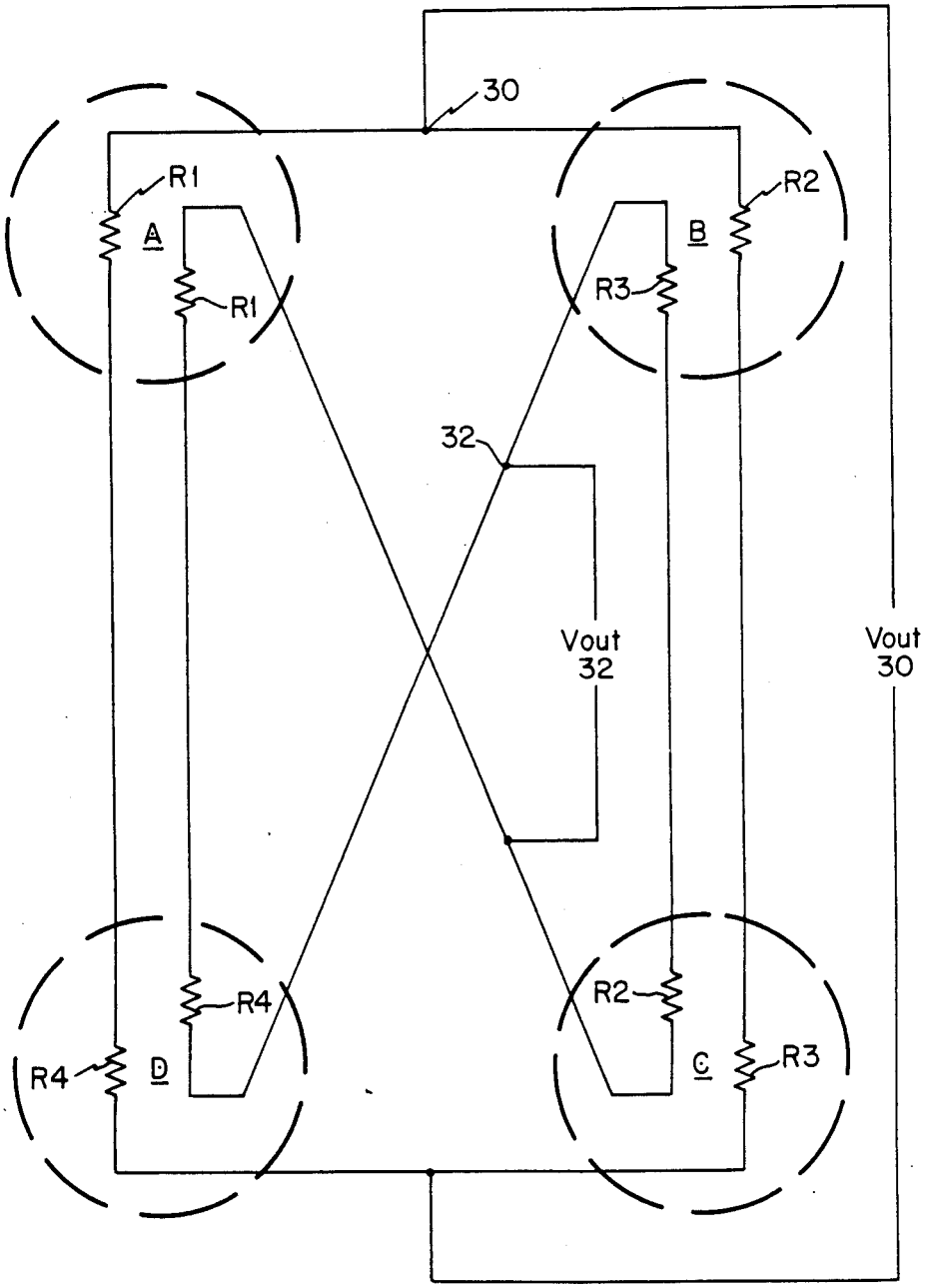
FIG. 4 is a diagram illustrating wheatstone bridge circuits located in the detection areas illustrated in FIG. 3.

DESCRIPTION OF THE PREFERRED EMBODIMENT:

The basic circuit in the intruder system is a conventional wheatstone bridge circuit of the type illustrated in FIG. 1. FIG. 1 illustrates a wheatstone bridge circuit 10 having four arms in a conventional manner within which are connected strain gages R1–R4 respectively. The circuit is provided with voltage from a DC power source 12 in the form of a battery connected to terminals 14, 15 and an output voltage V out is taken out at terminals 16, 18.

When the bridge circuit is balanced the output voltage V out equals 0. There is no output voltage. If, for example, the resistance in strain gage R1 doubles the bridge will no longer be balanced and V out will no longer be a zero voltage output. Balance can be restored if either the resistance in strain gage R2 is doubled or R4 is doubled or resistance in strain gage R3 is halved. In general if any one of the four strain gages changes in resistance value the bridge circuit will remain balanced (V out=0) if either adjacent strain gages changes in resistance similarly or if the opposite strain gage changes oppositely in resistance value. The sensitivity of the output voltage, V out, of the wheatstone bridge 10 to change in a single component strain gage has been the basis for conventional strain transducers.

In a typical application R1–R4 would each be a foil or semiconductor strain gage mounted on a strain-producing material in the area where stress is to be detected. In the detector system according to the invention the four strain gages R1–R4 are mounted to detect stress due to application of a weight pressure. Preferably the strain gages of all four arms of the bridge circuit are mounted on a similar material so that each strain gage is subjected essentially to the same expansion and contraction of the material due to temperature fluctuations.

While the perimeter intruding detector system is herein described with respect to a boat those skilled in the art will understand that intruder detection into any type of area can be secured by a system of the type described herein with modifications thereto with respect to location of the detection transducers or strain gages. As illustrated in FIG. 2 the individual strain gages, for example strain gage R1, are mounted by a suitable adhesive 20 to an underside surface of the boat main deck 22 which in this instance is the top deck of a boat. The individual detectors or strain gages are secured to the deck 22 at a point removed from a deck support 24 so that the strain gages can vary in resistance as a positive stress is applied on top the deck, for example, due to a person walking on the deck. It can be seen that since normally boat decks are of a same material the mounting of the strain gages on the underside of the deck 22 places them in substantially the same environment with respect to contraction and expansion coefficient of the material forming the deck 22 so that the problem of compensating in the bridge circuite for different contraction and expansion characteristics of materials is essentially reduced. The deck can be made of plastic, aluminum or wood in a conventional manner.

In the illustration show in FIG. 2 it is assumed the boat is already in existence so that the strain gages are mounted as shown by bonding to the deck. The detection system can be built into the deck of a boat while it is being built. The strain gages can be placed inside the deck, for example as strip strain gages responsive to extensive deck areas. The term "mounted on" here includes the placing of the strain gages inside the deck while the boat is being built.

The scheme of detection of an intrusion into an area such as the top deck 22 of a boat 26 is illustrated diagramatically in FIG. 3. It is desirable for the detection system to detect intrusion by an intruder onto the boat 26 by perimeter intruder detection prior to a break into any of any of the boat cabins. Accordingly the detection system provides for the use of two wheatstone bridge circuits, as later described, in which the strain gages in the four arms of the individual wheatstone bridges are located in four areas A, B, C and D including therein the perimeter of the deck 22 of the boat 26. The four areas A–C are selected so that two areas A, B are on a forward part of the boat deck and are of sufficient area so that the intrusion on the forward part of the boat can be detected. The after part of the boat deck 22 has two detection areas C, D located for detection of aft and stern intrusions. The selection of the four detection areas and location with respect to the perimeter of the boat 26 is made taking into consideration the design of the boat and the probable interest of an intruder such as the location of cabins and other structures or equipment.

The detection system requires at least two wheatstone bridge circuits so that each of the four areas of detection is monitored by two strain gages. One strain gage is connected to one wheatstone bridge and another monitor strain gage within the same area is connected to another wheatstone bridge circuit as illustrated in FIG. 4. Two wheatstone bridges 30, 32 have their strain gages R1–R4 disposed in the four detection areas as illustrated. The electrical connections within the bridge circuits are permuted so that in the bridge circuit 30 the strain gage areas A and C are physically and electrically opposite, whereas in the second bridge circuit 32 they are electrically adjacent. Similarly for bridge 30 the strain gage areas B and D are opposite but B and D are electrically and physically opposite as illustrated and in bridge 32 they are electrically adjacent.

Figure 5:
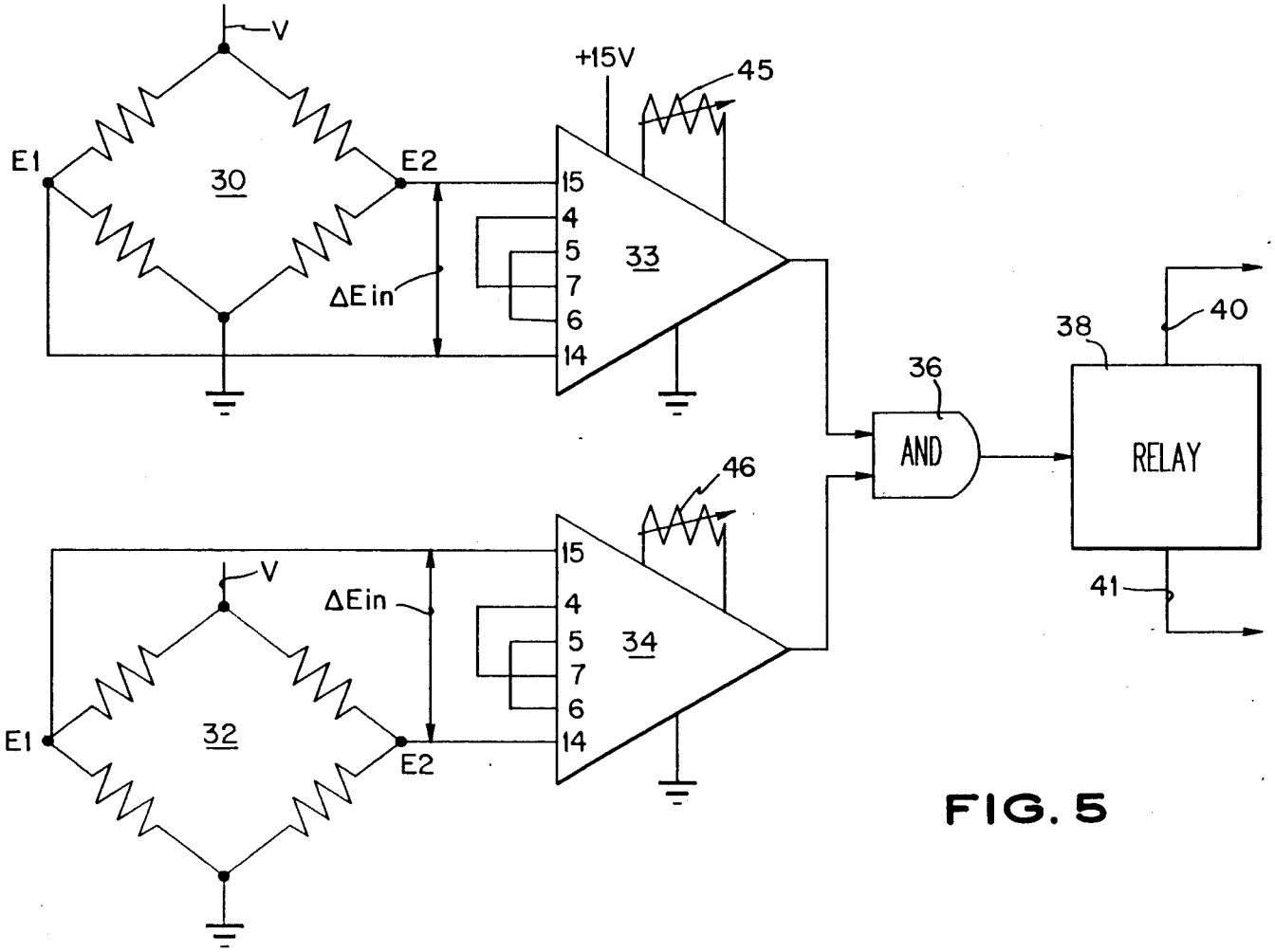
FIG. 5 is a schematic diagram of a perimeter intruder detection system according to the invention.

The outputs of the two permuted bridges 30, 32 are each connected, as shown in FIG. 5, to separate instrumentation amplifiers 33, 34. The voltage outputs of the instrumentation amplifiers are connected to an AND logic gate 36. When both bridge circuits 30, 32 are unbalanced simultaneously the output of the AND logic gate will be high and will energize a normally open relay 38 and it will close to activate a monitor conventional alarm board through an output connection 40 or signal alarm through output 41 and the like monitor or recording systems. Those skilled in the art will recognize that the relay 38 can also be normally closed if desired.

The detection system provides for variably adjusting the sensitivity of the individual wheatstone bridge circuits 30, 32. The sensitivity adjust provides compensation adjustment for weather conditions such as heavy snowfalls and for avoiding activating the alarm system in such conditions and for a cat or some animal of that type walking on the deck of the boat.

The preferred embodiment is the use of the multiple permuted bridge system. This configuration allows adjacent gages on the bridge to mutually compensate. There are stresses developed on a boat which differ with respect to the environmental situation on a boat. Torsion on a boat will affect opposite strain gages of the same bridge similarly, for example the strain gages R1 and R3. Tortional stress would otherwise unbalance the corresponding bridge and falsly indicate presence of an intruder.

For example, since the detection area A is on the forward port side of a boat and the detection area B is on the forward starboard detection area and detection area C is aft starboard and detection area D is aft port then rain hitting the forward part of the boat will be detected by detection sites A and B which will unbalance the second bridge 32. The first bridge 30 remains balanced. Accordingly there is no alarm activation. Rain hitting the left or port side will be detected by areas A and D which would leave both bridges balanced. Thus there is no alarm activation. A torsional stress affecting areas B and D would unbalance the first bridge 30 but leave the second bridge 32 balanced. Accordingly there is no alarm activity.

An intruder, however, will affect only a single detection area at one time and will unbalance both bridges in the detection area so that there is alarm activation. The instrumentation amplifiers allow further flexibility for control of detection system sensitivity. Improper installation, remodeling or temporary storage of equipment in a detection area can be compensated by re-zeroing (offset adjustment on the individual amplifiers by offset connections of the individual amplifiers.) The individual amplifiers are provided with tare or offset adjustments 45, 46 without affecting sensitivity and the individual gain adjust connections 4–6 provide for gain adjustments on the individual amplifiers allowing individual selections of sensitivity due to environmental and operating conditions with respect to the individual detection areas.

Working conditions on the boat may require tare adjustment. For example, the movement of stored material onto a detection area or removal therefrom may require tare adjustment of a particular wheatstone bridge circuit in order to avoid activating the alarm. The perimeter intruder detection system thereby provides for the working conditions of the boat. The bridges can be offset without affecting sensitivity.

Those skilled in the art will understand that more paired wheatstone bridge circuits than the two disclosed can be used in the detector system. This can provide for intruder detection at more sites which can be selected as desired in accordance with the main deck configuration.

I claim:

1. A perimeter intruder detection system for an area to be secured against intrusion, such as a boat or the like, comprising two paired wheatstone bridge circuits, each arranged with the four arms thereof in four corresponding areas within a larger area the perimeter of which is to be secured, each wheatstone bridge circuit having an arm in each of said corresponding areas where the other wheatstone bridge circuit has an arm, each wheatstone bridge circuit having a strain gage in each arm so that each of the four areas has two strain gages therein for detection of entry and continued presence of an intruder, means in each of the four areas defining a corresponding strain-producing surface on which the corresponding strain gages are mounted and which produces strain in response to application of a weight pressure force thereto upon entry of an intruder into the corresponding area and continued presence therein, each wheatstone bridge circuit having a voltage input connection and a voltage output, each wheatstone bridge circuit having a corresponding amplifier connected to receive the voltage output thereof, each amplifier having an adjustment means for adjusting the sensitivity of the corresponding wheatstone bridge circuit to pressure from weight detected by said strain gages thereof, and an AND gate connected to receive the voltage outputs of the two amplifiers, the AND gate having an output connection for outputting a detection voltage.

2. A perimeter intruder detection system according to claim 1, in which said strain gages are ribbon gages.

3. A perimeter intruder detection system according to claim 1, in which each strain gage is disposed to detect pressure on an area of a top deck of a boat corresponding to one of said four corresponding areas.

4. A perimeter intruder detection system according to claim 3, in which each strain gage of the two wheatstone bridge circuits is mounted on an underneath surface of the top deck of said boat.

5. A perimeter intruder detection system according to claim 1, further including means responsive to the output voltage of the AND gate for activating a monitor for indicating the detection of an intrusion.

6. A perimeter intruder detection system for an area to be secured against intrusion, such as a boat or the like, comprising two paired wheatstone bridge circuits, each arranged with the four arms thereof in four corresponding areas within a larger area the perimeter of which is to be secured, each wheatstone bridge circuit having an arm in each of said corresponding areas where the other wheatstone bridge circuit has an arm, each wheatstone bridge circuit having a strain gage in each arm so that each of the four areas has two strain gages therein for detection of entry and continued presence of an intruder, means in each of the four areas defining a corresponding strain-producing surface to which the corresponding strain gages are attached and which produces strain in response to application of a weight pressure force thereto upon entry of an intruder into the corresponding area and continued presence therein, each wheatstone bridge circuit having a voltage input connection and a voltage output, each wheatstone bridge circuit having a corresponding amplifier connected to receive the voltage output thereof, each amplifier having an adjustment means for adjusting the sensitivity of the corresponding wheatstone bridge circuit to strain from weight detected by said strain gages thereof, each amplifier having tare means for balancing the corresponding bridges by tare without affecting the sensitivity of the corresponding bridge, and an AND gate connected to receive the voltage outputs of the two amplifiers, the AND gate having an output connection for outputting a detection voltage signal.

7. A perimeter intruder detection system according to claim 6, in which said tare means comprises means for effecting the equivalent for zeroizing the corresponding bridge.

* * * * *